US006854536B2

(12) United States Patent
England et al.

(10) Patent No.: US 6,854,536 B2
(45) Date of Patent: Feb. 15, 2005

(54) PILE REAMER WITH SPOIL CONTAINER

(75) Inventors: Melvin Gerrard England, Middlesex (GB); Ronald Peter Payne, Buckinghamshire (GB)

(73) Assignee: Cementation Foundations Skanska Limited, Hertfordshire (GB)

( * ) Notice: Subject to any disclaimer, the term of this patent is extended or adjusted under 35 U.S.C. 154(b) by 0 days.

(21) Appl. No.: 10/467,621

(22) PCT Filed: Jan. 14, 2002

(86) PCT No.: PCT/GB02/00136

§ 371 (c)(1),
(2), (4) Date: Jan. 15, 2004

(87) PCT Pub. No.: WO02/063104

PCT Pub. Date: Aug. 15, 2002

(65) Prior Publication Data

US 2004/0108143 A1 Jun. 10, 2004

(30) Foreign Application Priority Data

Feb. 8, 2001 (GB) ..... 0103163

(51) Int. Cl.[7] ..... E21B 7/28
(52) U.S. Cl. ..... 175/311; 405/237
(58) Field of Search ..... 175/406, 311; 405/237

(56) References Cited

U.S. PATENT DOCUMENTS

| | | | | | |
|---|---|---|---|---|---|
| 167,628 | A | * | 9/1875 | Summers | 175/292 |
| 1,406,348 | A | * | 2/1922 | Corrigan | 175/97 |
| 2,031,353 | A | * | 2/1936 | Harvey | 175/285 |
| 3,112,802 | A | * | 12/1963 | Gustav et al. | 175/285 |
| 3,231,029 | A | * | 1/1966 | Winberg | 175/53 |
| 3,414,069 | A | * | 12/1968 | Kammerer, Jr. | 175/268 |

FOREIGN PATENT DOCUMENTS

| | | |
|---|---|---|
| GB | 2 222 621 | 3/1990 |
| JP | 60168813 | 9/1985 |
| SU | 1484878 | 6/1989 |

* cited by examiner

*Primary Examiner*—Hoang Dang
(74) *Attorney, Agent, or Firm*—Browdy and Neimark, P.L.L.C.

(57) ABSTRACT

The present application relates to a tool having a cutting apparatus for enlarging a portion of an underground pile shaft. The tool is provided with a collecting device which is disposed below the cutting means in order that spoil generated when performing a cutting action on ground material surrounding the pile shaft can be collected. The size of the collecting device is adjustable thereby allowing the volume of spoil which may be accommodated by the collecting means to be varied. A compacting mechanism for compressing the spoil collected in the collecting device may also be provided for reducing the volume of the spoil.

18 Claims, 4 Drawing Sheets

PILE REAMER WITH SPOIL CONTAINER

BACKGROUND OF THE INVENTION

1. Technical Field of the Invention

This invention relates to the construction of piles and, in particular, relates to a tool for enlarging a portion of an underground pile shaft.

2. Prior Art

The process of forming an enlarged portion in a pile shaft, known as a ream or an underream, is well known. The benefits of the enlarged surface can be seen in the contribution to the end bearing capacity of the pile and, furthermore, the friction experienced between the surface of the resultant pile and the surrounding soil is enhanced, thereby contributing to the overall load bearing capacity of the pile.

The process of underreaming piles is long established. Where the ground is stable, for example in stiff clays, a pile shaft is usually bored to a given designed depth and then a tool is inserted which is used to enlarge the pile shaft. This tool is conventionally cylindrical in form, and known designs comprise two long open slots which are located in diametrically opposed positions of the cylindrical body side. Within each slot is a cutting arm, which is most commonly hinged at the top. Prior designs are also known where the cutting arms are hinged at the bottom. In both cases, the cutting arms are connected by a linkage to the drilling or Kelly bar of a rotary boring machine so that when the bar is moved downwards and the base of the reaming tool rests on the bottom of the hole, the arms are forced outwardly. On retraction of the drilling bar, the arms are also retracted. While the arms are extended from the underreamer body and are pressing against the surrounding soil, the tool is rotated by the drilling bar so that a soil cutting action is performed. Soil is drawn into the body or centre part of the tool and from time to time the tool is withdrawn from the hole in the ground where the cut soil is removed.

Underreaming is carried out, for example, in forming ground anchors in clay where the objective is to apply loads to the anchor which tend to withdraw it from the ground, so that the process of cleaning the bottom of the shaft is unimportant and does not affect the performance of the anchor. Typically, holes of up to 300 mm diameter are used for ground anchors. In contrast, where a pile is to be constructed, the downward load carried by the pile is transmitted to the ground through the base of the pile shaft, and consequently it has been found that base cleaning of such pile shafts is critical in assuring satisfactory and consistent performance in piles.

In United Kingdom patent GB 2222621, an underreamer is described which comprises a cylindrical body having at least on slot through which a cutting member can protrude. The tool was designed to enable the cutting member to be retracted inside the cylindrical body while the tool is lowered into, or raised from, a pre-formed shaft. An elongate container is also provided below the cutting member so as to collect the spoil generated during the cutting of the surrounding shaft.

However, the volume of spoil generated will invariably be greater than the volume of the material before it is cut from the pile shaft. The so-called "bulking" of the material is dependent on a number of factors including soil type, cutting technique and tool configuration.

It has been found however, that currently available tools for enlarging a portion of an underground shaft, suffer from the disadvantage that in many instances, the spoil generated during the shaft enlarging process, either falls to the bottom of the shaft, or does not all fit in the container if one is provided. For example, when using the tool described in GB 2222621, it has often been necessary to carry out a number of separate operations in order to form the required enlarged portion. In order to alleviate this problem, the tool is initially employed with the cutting arms only partially extended so that a fraction of the required ream is cut. The container is then raised and emptied and the process repeated with the cutting arms extended to a further extent.

Alternatively, larger containers have been employed to accommodate the volume of spoil generated. This can however be a disadvantage since the cutting part of the tool cannot be lowered close enough to the base of the pile shaft to be of maximum benefit.

Reliability of installation requires that excess spoil is extracted from the shaft. Spoil which remains in the shaft until the tool is extracted, and which is not accommodated in a container, will fall to the bottom of the bore. Consequently the tool cannot be inserted to the same depth and therefore an enlarged surface cannot be formed at the base of the bore. This can also cause a ream or underream to perform poorly because the material which rests on the bore surface does not have the same strength and stiffness as the uncut, compacted material. This can significantly affect the bearing capacity of the resulting foundation element.

OBJECT AND SUMMARY OF THE INVENTION

It can therefore be appreciated that there is a need for a tool for enlarging a portion of an underground shaft, which is capable of accommodating a varying amount of spoil generated during the enlarging process, and which does not require the performance of a number of cutting operations.

According to one aspect of the present invention, there is provided a tool for enlarging a portion of an underground shaft, which tool comprises:

(a) a generally cylindrical body portion the axis of which defines an axis of rotation;

(b) a cutting means for performing a cutting action on surrounding ground material when the tool is rotated about said axis of rotation; and (c) a collecting means attached to, or forming part of the cylindrical body portion, said collecting means being disposed below said cutting means such that, in use, spoil generated by said cutting means is collected therein, characterised in that the size of the collecting means is adjustable thereby allowing the volume of spoil which may be accommodated by the collecting means to be varied.

The collecting means which forms part of the tool of the present invention can be advantageously adjusted such that the volume of spoil which can be accommodated therein is optimised according to the ground conditions and the technique.

A tool according to the present invention preferably allows a ream to be constructed in an underground pile shaft in a single operation. By choosing the optimum size of the collecting means, by consideration of, for example, the soil characteristics, all of the spoil can advantageously be accommodated in the collecting means. Furthermore, the adjustability of the collecting means, allows the position of the ream to be determined without being restricted by the dimensions of the collecting means.

The collecting means preferably comprises a hollow, cylindrically shaped body which is closed at one end. It may be formed of any suitable material such as metal or plastic. The collecting means may advantageously be formed of a number of cylindrical sections which are telescopic; the size of the collecting means being determined by the degree of extension of the cylindrical sections. Alternatively, a single cylindrical section is envisaged which can slide inside, or around, the cylindrical body portion of the tool.

A clamping means is advantageously provided which provides a means of continuously varying the position of the base of the collecting means, with respect to the cylindrical body. Alternatively, there may be a number of discrete positions at which the bottom of the collecting means can be fixed. The clamping means may be in the form of one or a plurality of bolts provided on either the collecting means or the cylindrical body which engage with slots. Alternatively the clamping means may be in the form of a captive bolt which communicates with a vertical or spiral slot. Any other clamping configurations are also envisaged.

Furthermore, preferred embodiments of the present invention are provided with a compacting means which is operable to exert a force on the collected spoil thereby reducing the volume of the spoil. The compacting means therefore enables a greater volume of material to be accommodated by the collecting means. For example a tool of the present invention may advantageously be provided with a compacting plate or a pair of compacting plates which are disposed within the collecting means. In use, the plate(s) advantageously extend either fully or partially across the diameter of the collecting means. The plate(s) may preferably be pivotally mounted on the inner surface of the collecting means so that they can rotate from a position in which the plate(s) lies adjacent to the side of the collecting means, to a position in which the plate(s) extend orthogonally from the inner surface of the compacting means. Alternatively, the plates may be pivotally mounted to a support which is disposed within the central region of the tool. Furthermore, a means to allow the plates to move up and down the axis of the compacting means is also provided so that, in use, the plate(s) can extend from a required position within the collecting means in accordance with the level of spoil contained within the collecting means. It is envisaged that one end of the plates, namely that end about which the plate(s) pivot, is provided with a toothed wheel which communicates with a complementary series of grooves provided on the collecting means. The toothed wheel can then be rotated, either by mechanical, electrical or hydraulic means, so that the teeth communicate with the grooves thereby allowing the plate(s) to move up and down within the collecting means.

The cutting means advantageously comprises at least one cutting member pivotally connected to the body portion of the tool. The sides of the cylindrical body of the tool are preferably provided with one or a number of slots such that the cutting member(s) can be extended through the slot(s) so to perform the cutting action on surrounding ground material. The cutting member is advantageously retracted within the cylinder body when not in use.

Embodiments of the present invention are envisaged in which the cutting member includes at least one blade which is advantageously arranged such that, when it protrudes through the slot or opening to the maximum possible extent, the maximum area is made available within the tool for the collection of any cuttings.

A number of different blade configurations are envisages such as linear or arcuate shaped blades.

Conveniently, the blade(s) may be in the form of metal struts hinged at their inboard ends directly or indirectly to said cylindrical body portion.

Advantageously, the blade(s) are caused to move by a mechanical linkage arrangement when the tool is in use. Alternatively, a hydraulic operating system may be employed, e.g. a hydraulically-linked piston and a pair of rams, one acting on each of two cutting members.

Conveniently, each slot through which a cutting member protrudes is arranged with its major axis parallel to the axis of rotation. Other arrangements, i.e. in which the slot is arranged obliquely with respect to the axis of rotation, are also possible.

Preferably, the tool has two opposed slots each containing a similar cutting member. The upper part of the cylindrical body portion will generally include a coupling connection for drilling (Kelly) bar of a rotary boring machine.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE PREFERRED EMBODIMENTS OF THE INVENTION

Figure 1:
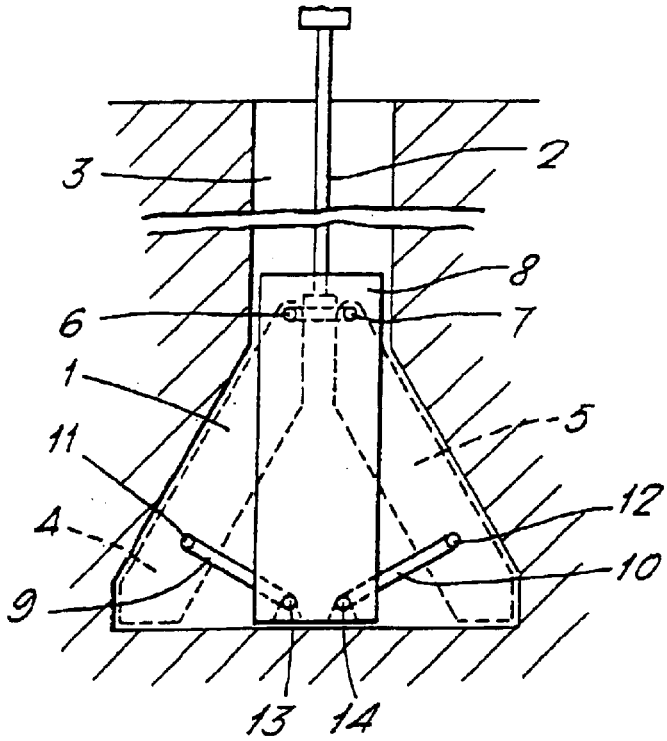
Fig.1 (PRIOR ART)
FIG. 1 illustrates a conventional underreaming tool of the type widely used in commercial practice.

Referring first to FIG. 1, a known underreaming tool 1 is secured to a drilling bar 2 located within a shaft 3. The tool 1 comprises a pair of opposed blades 4 and 5 pivotally connected to a generally cylindrical body 8 by hinges 6 and 7, respectively which are located at the top of each blade. Pivoting linkages 9 and 10 are connected to blades 4 and 5 at the points 11 and 12 respectively, and are connected to the base of cylindrical body portion 8 at points 13 and 14, respectively. In use, such an underreaming tool is first lowered into pre-formed shaft 3; in this condition, linkages 9 and 10 adopt a more or less vertical orientation, and the wing-like blades 4 and 5 are retracted into the hollow interior of cylindrical body 8. When the tool 1 reaches the base of the shaft, the drilling bar 2 is pushed downwardly, thus urging blades 4 and 5 to pivot outwardly, this movement coupled with rotational movement resulting in scraping away of ground material from the sides of the shaft in contact with blades 4 and 5. At the end of the remaining operation, the base of the shaft is enlarged to a frustoconical shape. Spoil that is generated during the cutting operation and which is not compacted into the wall of the bore, will fall to the base of the bore. This will have a detrimental effect on the performance of the resulting pile shaft.

Figure 2:
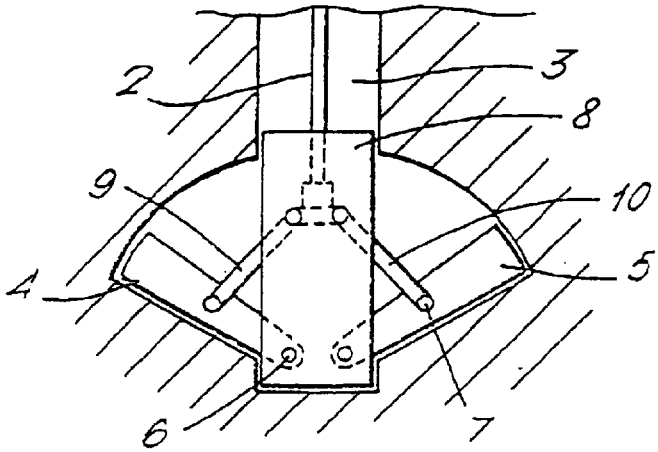
Fig.2. (PRIOR ART)
FIG. 2 illustrates a further known design of underreaming tool.

Referring next to FIG. 2, a further known underreamer is depicted. The same reference numerals as were used in FIG. 1 are used here to denote similar components. With the FIG. 2 arrangement, hinges 6 and 7 are located at the bottom end of blades 4 and 5, while linkages 9 and 10 are disposed upwardly of hinges 6 and 7. As with the FIG. 1 arrangement, the blades 4 and 5 nest inwardly (with linkages 9 and 10 substantially vertical) when the tool is lowered into shaft 3. Rotation of the tool when it is at the base of the shaft after blades 4 and 5 have moved outwardly under downward pressure from drilling bar 2 results in excavation of a sector of a sphere which is conical in section.

With tools of the type shown in FIGS. 1 and 2, it is necessary to make repeated cutting operations between each of which spoil generated by the previous cutting stage is removed from the base of the shaft. This is an inconvenient and time-consuming operation, generally requiring a worker to supervise the operation of debris removing equipment.

Figure 3:
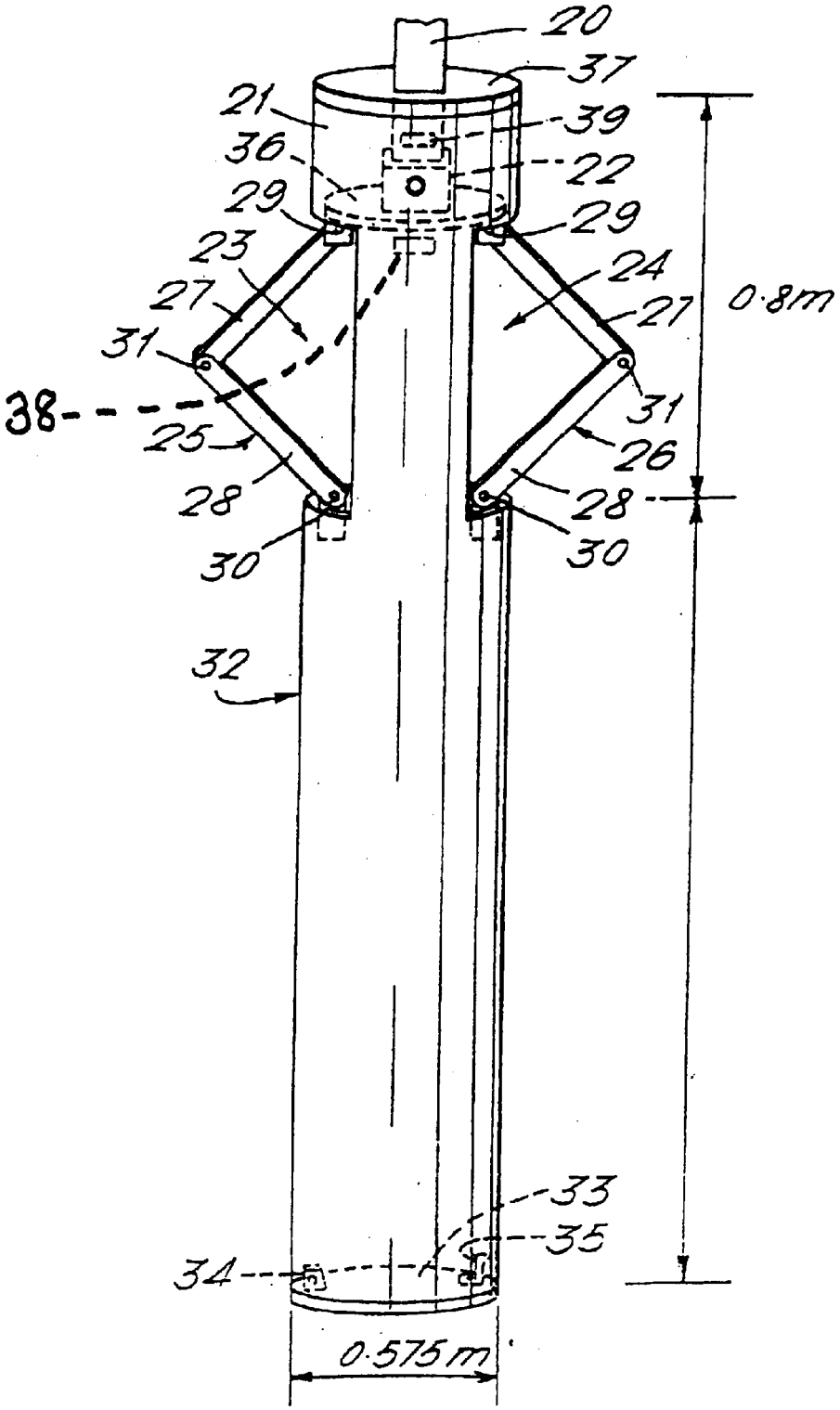
FIG. 3 illustrates an embodiment of the present invention.

Referring now to FIG. 3, a tool according to the present invention is depicted which comprises a cylindrical body portion 21 having at its top end a coupling connector 22 adapted to receive drilling bar 20. The body 21 includes two opposed slots 23 and 24 through which cutting members 25 and 26 are able to protrude. It should be appreciated that the configuration of the cutting means is not significant to the present invention and that a number of other blade configurations may also be employed. In this example, each cutting member comprises an upper blade 27 and a lower blade 28. Each blade is in the form of a linear strut hinged at the inboard end to a plate 36 which is able to move upwardly and downwardly between stop members 38 and 39 within body 21. The upper hinges are denoted by reference 29, and the lower hinges by reference 30. The limit of upward movement of plate 36 is determined by the stop member 39, although in an alternative arrangement the inner surface of the end face 37 of body 21 can act: as a stop member instead of item 39. Each blade 27 pivotally connected to its companion blade 28 by a hinge 31. Thus in the configuration illustrated, the two cutting members adopt a "V"-shaped form. Each stop member 38 and 39 may take the form of two steel blocks (one on each side diametrically of the interior of body 21) which may be welded to the inner side wall of body 21. Alternatively, each stop member 38 and 39 may take the form of a cross bar extending across the interior of body 21.

Stop member 38 is positioned so that when cutting member 25 and 26 are extended to their maximum, the members 25 and 26 are extended to their maximum, the slope of lower blades 28 is kept at an angle which allows cut spoil to roll down into the interior of container 32. Typically this angle will be about 30°.

The tool is provided with an adjustable container 32 which is disposed below the cutting members and serves to catch spoil produced during the cutting operation. The length of the container 32 is denoted by X which will vary. The position of the base 33 of the adjustable container 32 is releasably secured by means of clamps 34 and 35 which allow the bottom of the base to be secured in a number of discrete positions.

In use, the tool is first lowered into a pre-formed shaft, during which the cutting members 25 and 26 are retracted into the interior of body portion 21. Stop member 39 is located so that, with the cutting members retracted, hinge joint 31 is just outside the line joining points 29 and 30 so that when the action of moving cutting members 25 and 26 begins there is always a tendency for blades 27 and 28 to move outwardly. When the adjustable container 32 reaches the base of the shaft, drilling bar 20 is rotated while under downward pressure, this serving to force cutting members 25 and 26 to protrude through slots 23 and 24 and to cut away the surrounding ground material. As material is cut, the rotational sweeping of the cutting members together with the inclined lower floor of the enlarged shaft section encourages spoil to enter the adjustable container 32. The size, and thus the capacity, of the container 32 is chosen, either prior to commencing the operation or during the cutting stage, such that all of the ground material cut in generating the enlarged shaft portion can be accommodated therein. A single operation is therefore all that is required in forming the enlarged portion. Furthermore, the need to supervise the operation of debris removing equipment is alleviated. At the end of this operation, rotation of drilling bar 20 is stopped, and bar 20 and the tool to which it is attached are raised. Initially, this results in cutting members 25 and 26 retracting into the body 21, as blade 36 moves upwardly towards stop member 39. When parts 36 and 39 meet, blades 27 and 28 are within slots 23 and 24, but are not quite co-linear. This prevents any tendency for hinge joint 31 to move inwardly instead of outwardly when the next reaming operation is commenced. Once members 25 and 26 are within slots 23 and 24, respectively, further lifting action applied will result in the tool being raised to the surface.

A tool of the type illustrated in FIG. 3 has a number of important advantages compared to the prior art tools of FIGS. 1 and 2. These are:

(a) The underreaming process is carried out in a single journey of the tool into and out of the shaft bore and the tool is able to remove the complete volume of a ream as cut soil in the single journey and operation.

(b) The tool produces a sloping floor to the underream as cut, so that the base of the ream is self-cleaning—the combined slop and rotation serving to propel cut earth into the cylindrical body of the soil container in the bottom section of the tool.

Figure 4A:
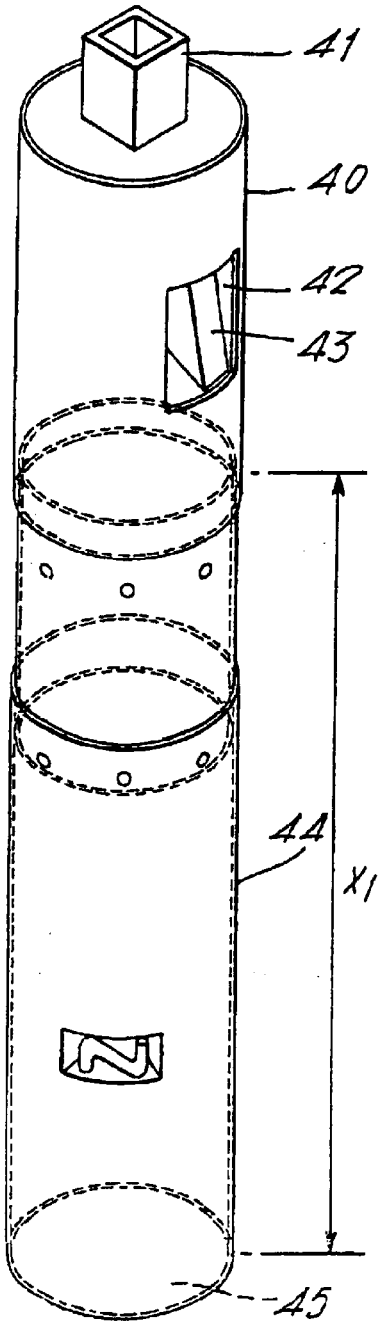
FIGS. 4A and 4B illustrate an example of an adjustable collecting means.
Figure 4B:
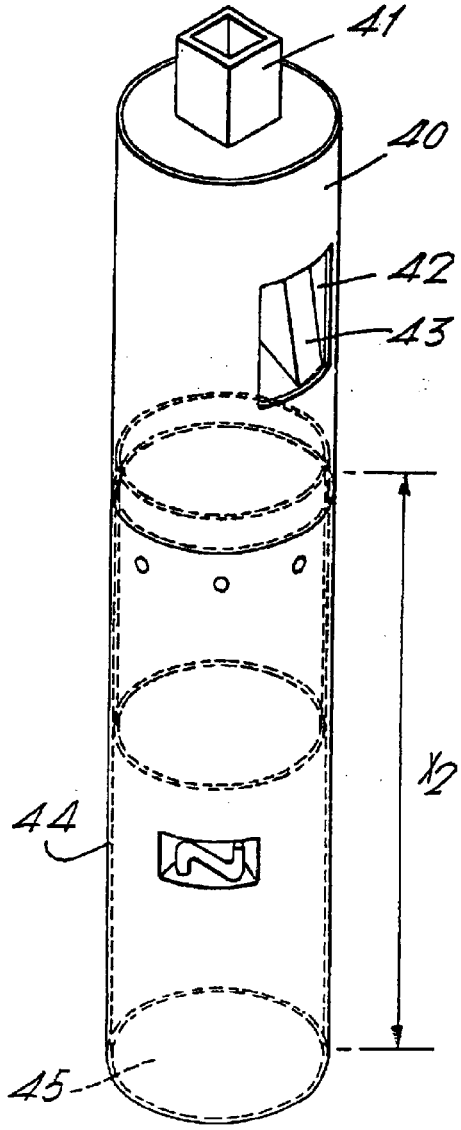

The adjustable container is illustrated more clearly in FIGS. 4A and 4B. The tool comprises a cylindrical body portion 40 having at its top end a coupling connector 41 adapted to receive a drilling bar. A pair of slots 42 are provided through which the cutting means 43 can protrude when performing a cutting action on the surrounding soil. FIG. 4A shows the adjustable collecting means 44 having a total length X1. The collecting means comprises two telescopic cylindrical portions which are adapted to slide within one another so as to adjust the volume of soil which can be accommodated within the collecting means. In FIG. 4B, the size of the collecting means has been reduced to X2 such that the position of the base portion 45 is nearer to the cylindrical body portion 40.

A number of different embodiments of the present invention are illustrated in FIGS. 5A to 5D.

Figure 5A:
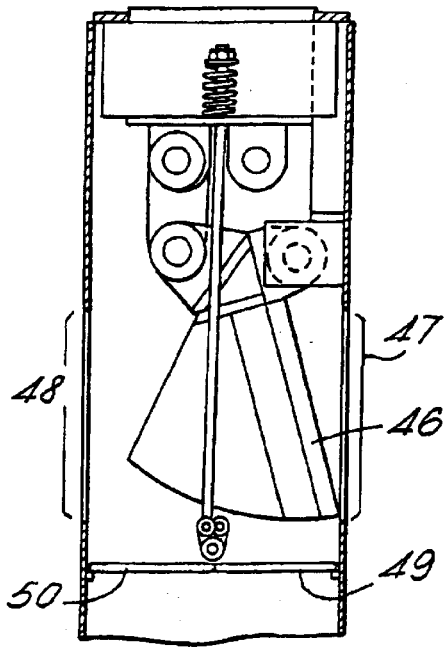
FIGS. 5A–5D the compacting means of the present invention.
Figure 5B:
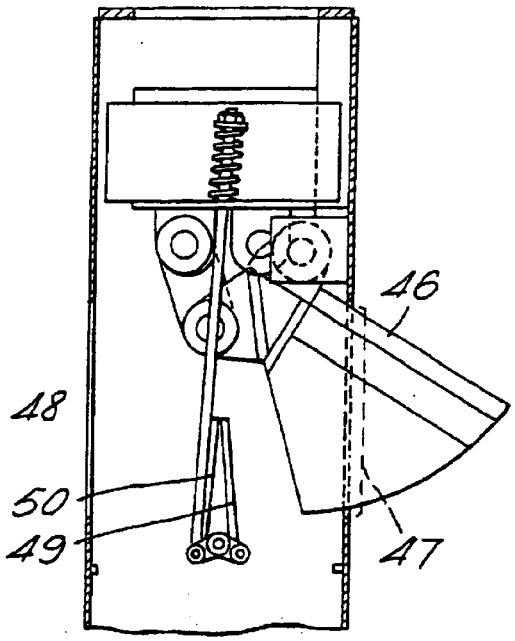

FIGS. 5A and 5B illustrate a tool of the present invention in a first position (5A) when the blade 46 is retracted within the cylindrical body portion, and in a second position (5B), when the blade extends through the slot 47. In order to simplify the illustration, only one blade is shown however it should be appreciated that a second blade will also be provided which will extend through slot 48. A clamping means is provided which comprises a pair of compacting plates 49 and 50. The plates are pivotally mounted to a support 51 which extends along the central longitudinal axis of the tool. The plates(s) can be rotated from a first position shown in 5B, in which they extend upwardly in a direction substantially parallel to the central longitudinal axis of the tool, to a second position shown in 5A in which the plates extend across the radius of the tool, and are operable to exert a force on spoil collected below the plates.

Figure 5C:
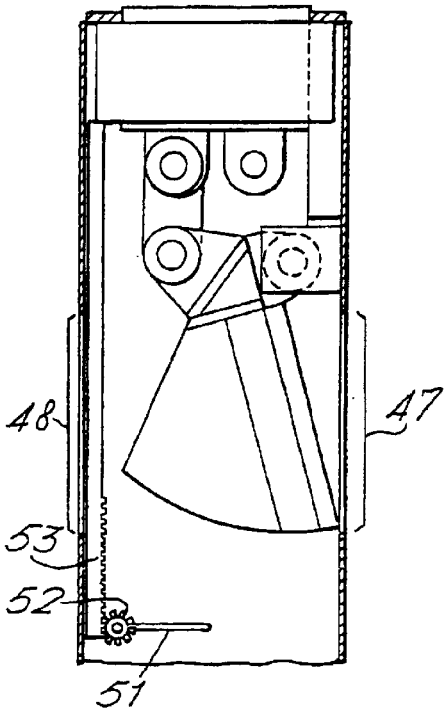
Figure 5D:
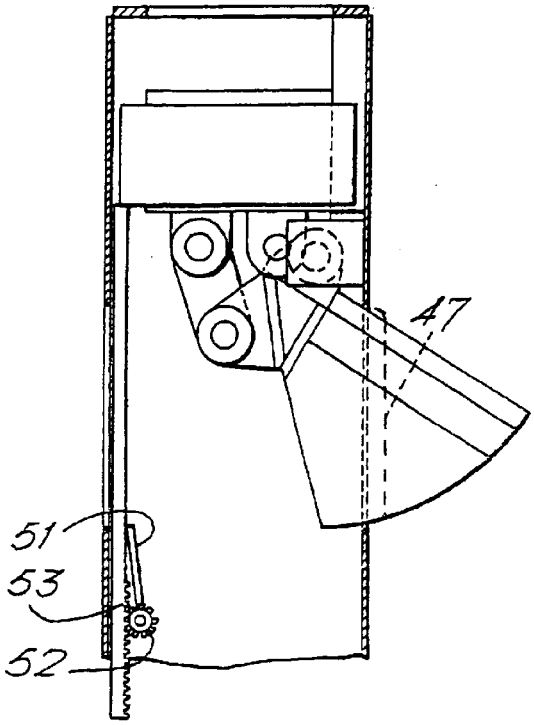

In FIGS. 5C and 5D a further compacting means is illustrated in which the plates 51 are pivotally mounted to the inner surface of the adjustable collecting means 52. Once again, for simplicity only one of the plates has been illustrated.

The plate 51 is provided at one end with a toothed wheel 52 which communicates with a series of complementary grooves 53 provided on the inner surface of the adjustable collecting means. The toothed wheel can then be rotated, either by mechanical, electrical or hydraulic means, so that the teeth communicate with the grooves thereby allowing the plate(s) to move up and down within the collecting means. Thus it is possible to adjust The position of the plates in accordance with the level of spoil contained in the adjustable collecting means and therefore to compact the soil so as to reduce the volume of space which is accommodated.

It will be appreciated that provision of an adjustable collecting means requires the underream to be cut at an appropriate level above the base of the borehole. The necessary distance between the ream and the base of the bore will depend upon the maximum shaft enlargement which is required. Typically, an enlargement up to a maximum of twice the bore diameter will be adopted, and the slop of the floor of the ream is about 30° to the horizontal. It is, of course, possible to adopt any desired values for bore enlargement and inclination of the lower cutting 1 blade at maximum extension.

When a pile is formed in an underreamed pile shaft produced with a tool in accordance with the present invention, pressure at the bottom of each pile ream may be expected to increase lateral stress on the soil beneath when a pile is loaded, thus increasing friction. Furthermore, the pile will have a useful tension capacity when required.

Compared to the production of piles in straight shafts, there is a considerable potential saving in operation time and costs by using a tool of this invention to form an underreamed pile shaft. Thus in constructing a pile 600 millimeters in diameter in ground formed of London clay, use of a tool as illustrate in FIG. 3 to produce an underream with a diameter of 1.2 m will require a soil container 32 1.5 m in length (allowing for bulking up of excavated material), which in turn means that an underreamed pile shaft will generate the same friction capacity as a linear shaft of the same diameter but approximately 8 meters deeper. The vertical extent of the ream will be 0.4 meters, and the cost of generating this underream will be significantly less than that of the extra 8 meters shaft extension which would otherwise be required to give the same pile friction.

What is claimed is:

1. A tool for enlarging a portion of an underground shaft, which tool comprises:

(a) a generally cylindrical body portion the axis of which defines an axis of rotation;

(b) a cutting means for performing a cutting action on surrounding ground material when the tool is rotated about said axis of rotation; and (c) a collecting means attached to, or forming part of the cylindrical body portion, said collecting means being disposed below said cutting means such that, in use, spoil generated by said cutting means is collected therein, characterized in that the size of the collecting means is adjustable thereby allowing the volume of spoil which may be accommodated by the collecting means to be varied.

2. A tool as claimed in claim 1, wherein the collecting means is hollow and generally cylindrical in shape.

3. A tool as claimed in claim 1, wherein the lower end of the collecting means is provided with a base portion which is attached to, or forms part of the collecting means.

4. A tool as claimed in claim 1, wherein the collecting means is formed of metal or plastic.

5. A tool as claimed in claim 1, wherein the collecting means comprises at least two cylindrical sections which are adapted to slide within each other so as to adjust the total length of the collecting means.

6. A tool as claimed in claim 5 wherein the lowest cylindrical section is provided with a base portion which is attached to, or forms part of the cylindrical section.

7. A tool as claimed in claim 1, further comprising a clamping means which serves to secure the adjustable collecting means to the cylindrical body portion.

8. A tool as claimed in claim 7, wherein the clamping means comprises at least one bolt which cooperates with at least one slot, wherein either the bolt is provided on the collecting means and the slot is provided on the cylindrical body, or visa-versa.

9. A tool as claimed in claim 1, further comprising a compacting means which is disposed above the level of the collected spoil, and is operable to exert a force on the top of the spoil so as to reduce the volume accommodated by the spoil.

10. A tool as claimed in claim 9, wherein the compacting means comprises at least one compacting plate, which, in use, extends either fully or partially across the diameter of the collecting means.

11. A tool as claimed in claim 9, wherein the compacting means comprises a pair of plates, each of the plates is pivotally mounted within the tool, and wherein the plates are rotatable from a first position, in which the plates lie substantially parallel to the longitudinal axis of the tool, to a second position, in which the plates extend in a direction substantially orthogonal to the longitudinal axis.

12. A tool as claimed in claim 11, wherein each of the plate(s) is provided with a toothed wheel which forms a sleeve about the pivotal end of the plate, and wherein a series of complementary grooves are disposed within the tool in such a way that when the toothed wheel communicates with the grooves, the plates are moved up and down within the collecting means.

13. A tool as claimed in claim 12, wherein the toothed wheel is driven along the series of grooves by pneumatic or electrical or hydraulic means.

14. A tool as claimed in claim 1, wherein the cutting means comprises at least one blade which is pivotally connected to the cylindrical body portion of the tool.

15. A tool as claimed in claim 14, wherein each of the blade(s) is arcuate in shape.

16. A tool as claimed in claim 14, wherein each of the blade(s) is linear in shape.

17. A tool as claimed in claim 14, wherein each of the blade(s) is in the form of a number of metal struts which are hinged at their inboard ends to the cylindrical body portion.

18. A tool as claimed claim 1, further comprising at least one slot in the side of the cylindrical body portion, wherein said cutting means is arranged, so as to protrude through said slot to perform a cutting action on the surround soil, and wherein the cutting means is retracted back through said slot in use.

* * * * *